United States Patent [19]

Schwager

[11] 4,327,517

[45] May 4, 1982

[54] STEERING MECHANISM FOR SCALE MODEL VEHICLES

[75] Inventor: Frederic A. Schwager, Manhattan Beach, Calif.

[73] Assignee: Mattel, Inc., Hawthorne, Calif.

[21] Appl. No.: 216,596

[22] Filed: Dec. 15, 1980

[51] Int. Cl.[3] ..... A63H 17/26; A63H 17/36

[52] U.S. Cl. ..... 46/221; 46/262; 280/96

[58] Field of Search ..... 46/262, 221, 206, 210, 46/211, 213, 212, 253, 254, 256, 251; 280/96

[56] References Cited

U.S. PATENT DOCUMENTS

| | | | |
|---|---|---|---|
| 2,167,245 | 7/1939 | Lohr et al. | 46/210 |
| 2,172,416 | 9/1939 | Swenson | 46/213 |
| 3,144,731 | 8/1964 | Jones et al. | 46/201 |
| 3,286,397 | 11/1966 | Lohr | 46/262 |
| 3,720,019 | 3/1973 | Waznys et al. | 46/244 A |
| 3,751,065 | 8/1973 | Sullivan | 280/788 |
| 3,878,521 | 4/1975 | Licitis et al. | 343/225 |
| 3,961,441 | 6/1976 | Akihiro Sato | 46/256 |
| 3,965,612 | 6/1976 | Asano | 46/262 X |
| 4,080,602 | 3/1978 | Hattori et al. | 46/262 X |
| 4,163,341 | 8/1979 | Jones et al. | 46/52 |
| 4,197,672 | 4/1980 | Kenichi Mabuchi et al. | 46/254 |

FOREIGN PATENT DOCUMENTS

| | | | |
|---|---|---|---|
| 1965028 | 7/1971 | Fed. Rep. of Germany | 46/262 |
| 1547138 | 6/1979 | United Kingdom | 46/262 |

*Primary Examiner*—Gene Mancene
*Assistant Examiner*—Mickey Yu
*Attorney, Agent, or Firm*—Ronald M. Goldman; Max E. Shirk; Roy A. Ekstrand

[57] ABSTRACT

A steering mechanism (10) for a scale-model vehicle (12) includes a pair of journal boxes (50), (51) having arcuate racks (56), (57) provided on their lower and upper cover plates (54), (53), respectively, for coacting with pinions (62) to swing wheel-carrying axles (60) through predetermined turning arcs when vehicle (12) is moved in reverse. Stops (110) and (112) are engaged by axles (60) to limit the turning arc in reverse and to hold the wheels (44), (46) on a straight course when vehicle (12) moves forwardly.

3 Claims, 6 Drawing Figures

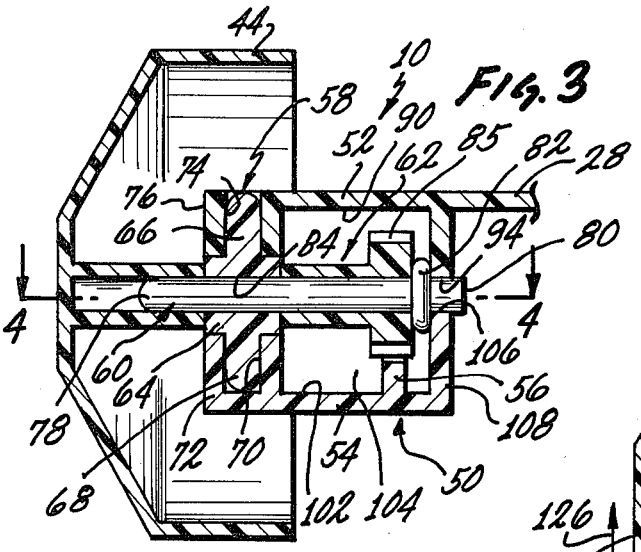
FIG. 3
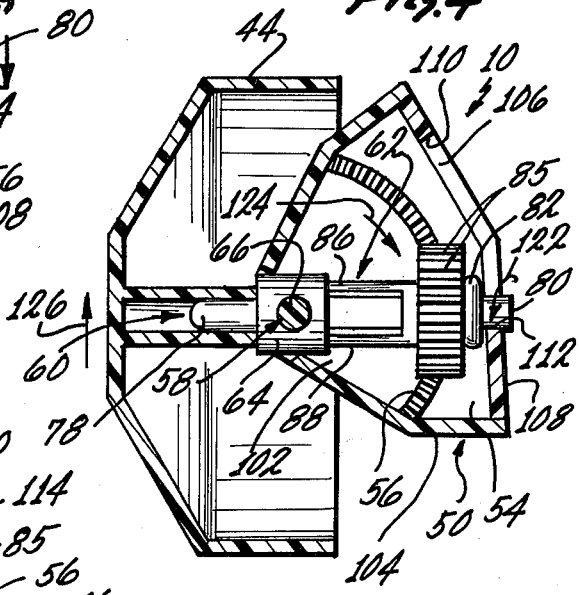
FIG. 4
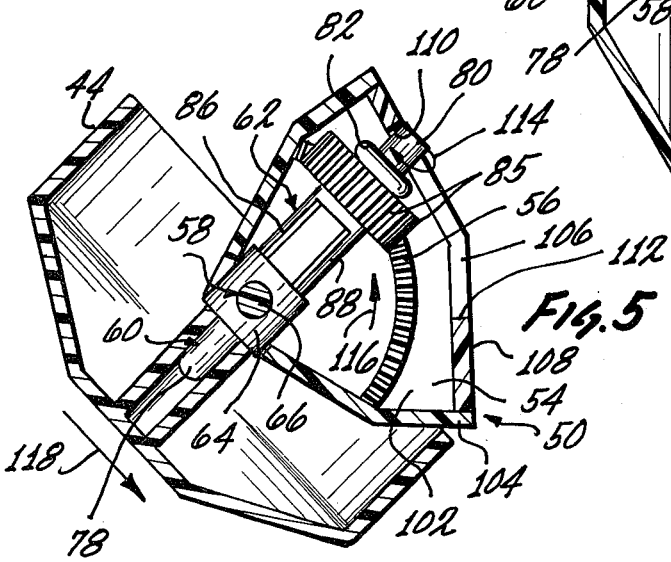
FIG. 5
FIG. 6
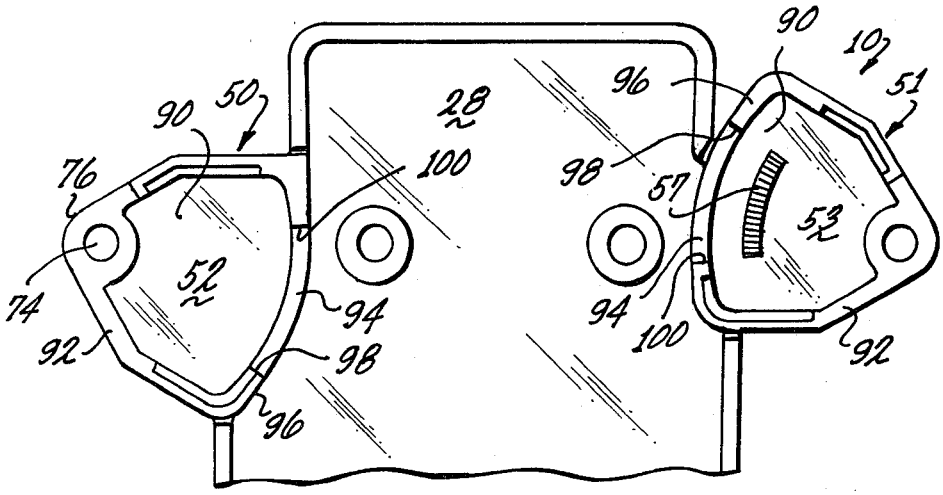

STEERING MECHANISM FOR SCALE MODEL VEHICLES

BACKGROUND OF THE INVENTION

1. Field of the Invention

The present invention relates generally to scale model vehicles and more particularly to a new and useful steering mechanism for scale model vehicles.

2. Brief Description of the Prior Art

The prior art known to applicant is of-record in separate communications to the U.S. Patent and Trademark Office. The device of the present invention exemplifies improvements over the devices shown and described in this prior art.

SUMMARY OF THE INVENTION

The present invention is directed, in brief, to a new and useful steering mechanism for scale model vehicles.

In its broader aspects, the present invention includes the provision of a steering mechanism in combination with a scale model vehicle having a chassis, a pair of driving wheels mounted to one end of the chassis and a pair of driven wheels mounted to the other end of the chassis.

The steering mechanism may comprise at least one king pin having a major axis and a minor axis and apparatus for rotatably mounting the king pin to one of the chassis ends with the major axis of the king pin lying in a vertical plane. A bore is provided in the king pin normal to its major axis and an axle is rotatably mounted in the bore. The axle includes an outboard end and an inboard end and the outboard end is nonrotatably coupled to at least one of the wheels in one of the pairs of wheels. A device is coupled to the axle for swinging it through a predetermined arc. A first mechanism is mounted to the chassis for uncoupling this device and for holding the axle in a position defining a straight course for the vehicle when it is travelling in a first direction. A second mechanism is mounted to the chassis for uncoupling the device and for holding the axle in a position defining a curved course for the vehicle after it has traveled a predetermined distance in a second direction opposite to the first direction.

The best mode currently contemplated for carrying out the invention includes the provision of first and second journal boxes each having an upper cover affixed to one end of the chassis and a lower cover affixed to the upper cover in spaced relationship therewith. A king pin is journalled in the outboard end of each journal box and a pair of spaced-apart stops are provided at the inboard end of each journal box. A first arcuate rack is affixed to the upper cover of one of the journal boxes intermediate its ends and a second arcuate rack is affixed to the lower cover of the other journal box intermediate its ends. The axle for each king pin extends inboard to a position between the stops. A pinion gear is carried by each axle intermediate its ends with the pinion gears engaging associate ones of the racks and being coupled to associated ones of the axles in a manner such that the pinion gears will coact with the racks to swing the axles and rotate the king pins until the inboard ends of the axles engage associated ones of the stops, whereupon the pinions will remain stationary while the axles are rotated by their associated wheels.

The features of the present invention which are believed to be novel are set forth with particularlity in the appended claims. The present invention, both as to its organization and manner of use, together with further objects and advantages thereof, may best be understood by reference to the following description, taken in connection with the accompanying drawings in which like reference characters refer to like elements in the several views.

BRIEF DESCRIPTION OF THE DRAWINGS

FIG. 3 is an enlarged, partial cross-sectional view taken along line 3—3 of FIG. 1;

FIG. 4 is a cross-sectional view taken along line 4—4 of FIG. 3 showing the righthand portion of the steering mechanism maintaining the right front wheel of the vehicle in a position for travel along a straight course;

FIG. 5 is a view similar to FIG. 4 with the wheel maintained in a position for travel along a curved path; and FIG. 6 is an enlarged, partial bottom plan view of the chassis of the vehicle of FIG. 1.

DESCRIPTION OF THE PREFERRED EMBODIMENT

Figure 1:
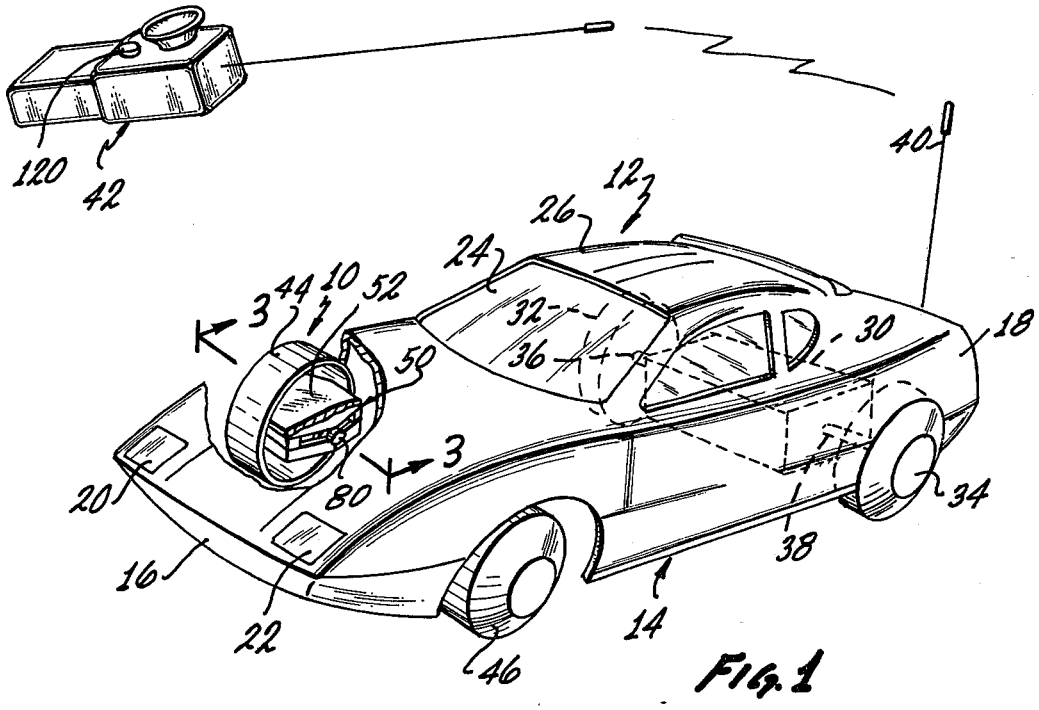
FIG. 1 is a perspective view of a scale model vehicle with parts broken away to show the righthand portion of a steering mechanism of the present invention.

Referring again to the drawings and more particularly, to FIG. 1, a steering mechanism constituting a presently-preferred embodiment of the invention, generally designated 10, is shown in combination with a scale model vehicle 12 including a body 14 having a front end 16, rear end 18, a pair of head lights 20, 22, a windshield 24 and a roof 26. Vehicle 12 also includes a chassis 28 to which a power module 30 may be mounted for driving rear wheels 32, 34 through rear axles 36, 38, respectively. Power module 30 may be a conventional single-function, radio-controlled unit having an antenna 40 receiving signals from a transmitter 42. Power module 30 includes a reversible electric motor (not shown) adapted to drive vehicle 12 forwardly when a signal is received from transmitter 42 and reversely when no signal is received from transmitter 42.

Vehicle 12 also includes a right front wheel 44 and a left front wheel 46 which are automatically controlled by steering mechanism 10 to maintain vehicle 12 on a straight course when it is moving forwardly and a curved course when it is reversed.

Referring now to FIGS. 1, 2, 3 and 6, steering mechanism 10 includes a righthand journal box 50 and a left hand journal box 51 (FIG. 6) having upper cover plates 52, 53, respectively, which may be formed integrally with chassis 28 during a molding operation employing suitable polymeric materials of types well known to those skilled in the art. Journal boxes 50, 51 each includes a lower cover plate, like the one shown at 54 for journal box 50, except that the lower cover plate for journal box 51 does not include an arcuate rack, as shown at 56 on lower cover plate 54 and at 57 for upper cover plate 53.

Steering mechanism 10 may also include pairs of king pins, axles and pinions like those shown at 58, 60 and 62, respectively, for righthand journal box 50.

Each king pin 58 includes an intermediate bearing portion 64, an upper spindle 66 and a lower spindle 68. Each king pin 58 may be rotatably mounted to chassis 28 by journalling lower spindle 68 in a suitable bore, such as the bore 70 provided in a cylindrical boss 72 forming the outboard end of lower plate 54 and by journalling upper spindle 66 in a bore 74 provided in a cylindrical boss 76 forming the outboard end of an associated one of the upper plates 52, 53.

Each axle or shaft 60 includes an outboard end 78, an inboard end 80 and a fixed annular collar 82 and is rotatably mounted in a bore 84 provided in bearing portion 64 normal to the major axis of king pin 58.

The outboard end 78 of each axle 60 engages an associated one of the wheels 44, 46 with a friction fit. Additionally, each axle 60 rotatably receives pinion 62 between king pin 58 and collar 82. Each pinion 62 includes a plurality of teeth 85 engaging an associated one of the racks 56, 57 and a split hub having fingers 86, 88 engaging axle 60 with sufficient frictional drag to be rotated by an associated one of the wheels 44, 46 through axle 60. Rotation of pinion 62 causes it to travel along its associated rack 56, 57 rotating king pin 58 about spindles 66, 68 and swinging shaft 60 in a horizontal plane until axle 60 engages a stop member to be hereinafter described. The frictional drag on axle 60 is then overcome permitting axle 60 to rotate in bore 84 and king pin 58 without imparting rotation to pinion 62.

Referring more in particular to FIG. 6, upper plates 52, 53 each includes a lower surface 90 encompassed by a sidewall 92 in which an arcuate notch 94 is provided at the inboard end 96 thereof. Each notch 94 includes first and second ends 98, 100, respectively, forming stop members against which end 80 of an associated axle 60 will be held to limit the arc through which axle 60 may be swung in a horizontal plane.

Figure 2:
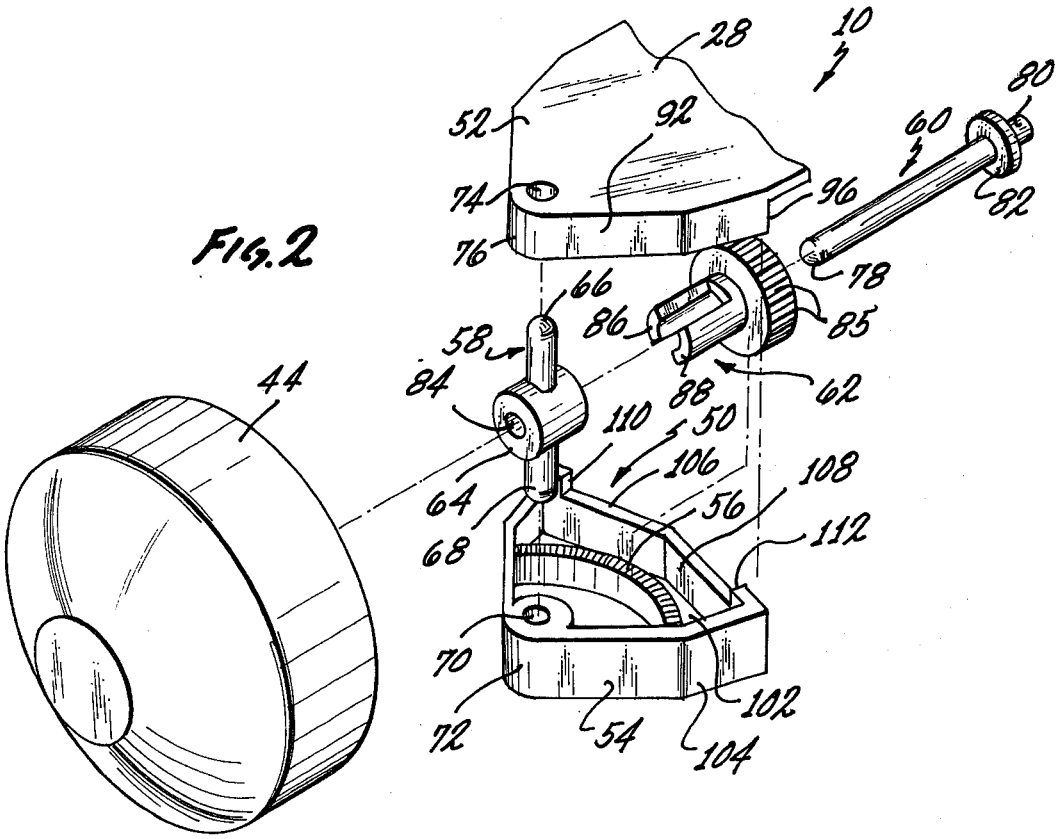
FIG. 2 is an enlarged, partial exploded view of the steering mechanism portion shown in FIG. 1.

As shown in FIGS. 2, 4 and 5 for lower plate 54, each lower plate includes an upper surface 102 encompassed by a sidewall 104 in which an arcuate notch 106 is provided at the inboard end 108 thereof. Each notch 106 includes first and second ends 110, 112, resepctively, forming stop members for axle 60.

As shown in FIGS. 1 and 2 for journal box 50, associated ones of the sidewalls 92, 104 may be joined together by suitable means, such as sonic welding techniques, to complete a housing for king pin 58, axle 60 and pinion 62.

The steering mechanism of the present invention may be made from a number of suitable materials. For example, chassis 28, plates 52, 53 and 54, king pin 58 and pinion 62 may be made from suitable polymeric materials and axle 60 may be made from steel. Acrylonitirle butadiene styrene (ABS) has been found to be satisfactory for the chassis and the plates; nylon or acetal may be used for the king pin and the pinion.

Operation of the steering mechanism of the present invention is believed to be apparent from the foregoing and is briefly summarized at this point. Referring to FIGS. 1, 4 and 5, assuming that front wheels 44 are set for travel in a straight line (FIG. 4), if vehicle 12 is then energized by closing a suitable switch (not shown) vehicle 12 will move in reverse causing wheel 44 to rotate axle 60 and pinion 62 clockwise, as indicated by arrow 114 in FIG. 5. This rotation causes pinion 62 to roll along arcuate rack 56 swinging end 80 of axle 60 from stop 112 (FIG. 4) to stop 110(FIG. 5), as indicated by arrow 116. The frictional drag imparted to axle 60 by fingers 86, 88 is then overcome and right front wheel 44 continues to move in the direction of arrow 118 (FIG. 5) causing vehicle 12 to follow a curved path in reverse until transmitter 42 is pulsed by depressing a button 120 provided thereon.

Actuation of button 120 reverses the current to the motor in module 30 causing vehicle 12 to move forward rotating axle 60 counterclockwise in the direction of arrow 122 (FIG. 4). Axle 60 then rotates pinion gear 62 causing it to roll over rack 56 in the direction of arrow 124 swinging end 80 of axle 60 from stop 110 to stop 112, whereupon the frictional drag between fingers 86, 88 and axle 60 is again overcome. Wheel 44 will then move forward in the direction of arrow 126 causing vehicle 12 to follow a straight course.

Referring now to FIG. 6, since rack 57 will be above pinion gear 62, it will be apparent that left front wheel 46 will move in a direction opposite to that shown in FIG. 5 for right front wheel 44.

While the particular steering mechanism herein shown and described in detail is fully capable of attaining the objects and providing the advantages hereinbefore stated, it is to be understood that it is merely illustrative of the presently preferred embodiment of the invention and that no limitations are intended to the details of construction or design herein shown other than as defined in the appended claims, which form a part of this disclosure.

Whenever the term "means" is employed in these claims, this term is to be interpreted as defining the corresponding structure illustrated and described in this specification or the equivalent of the same.

What is claimed is:

1. A steering mechanism for a scale model vehicle having a chassis and a pair of wheels, said steering mechanism comprising:

a pair of axles each having an outboard end non-rotatably coupled to one of said wheels and an inboard end;

means for rotatably mounting each of said axles to said chassis, each of said mounting means being rotatably mounted to said chassis, whereby each of said axles may be swung through predetermined arcs in a horizontal plane;

means affixed to said chassis for stopping each of said axles at each end of an associated one of said arcs; and means coupled to each of said axles for swinging said axles through said arcs said swinging means including a pinion gear frictionally coupled to each of said axles and a fixed arcuate rack engaging each of said pinion gears.

2. In combination with a scale model vehicle having a chassis, a pair of driving wheels mounted to one end of said chassis and a pair of driven wheels mounted to the other end of said chassis, the improvement which comprises:

at least one king pin having a major axis and a minor axis;

means for rotatably mounting said king pin to one of said chassis ends with the major axis of said king pin lying in a vertical plane;

a bore provided in said king pin normal to said major axis;

an axle rotatably mounted in said bore, said axle including an outboard end and an inboard end, said outboard end being non-rotatably coupled to at least one of the wheels in one of said pairs of wheels;

means coupled to said axle for swinging said axle through a predetermined arc;

first means mounted to said chassis for uncoupling said swinging means and holding said axle in a position defining a straight course for said vehicle when it is travelling in a first direction; and second means mounted to said chassis for uncoupling said swinging means and holding said axle in a position defining a curved course for said vehicle after said vehicle has travelled a predetermined distance in a second direction opposite to said first direction.

3. A steering mechanism for a scale model vehicle having a chassis and a pair of wheels, said steering mechanism comprising:

first and second journal boxes, each of said journal boxes including an upper cover and a lower cover;

a king pin journalled in one end of each of said journal boxes, each of said king pins being provided with a transverse bore;

a pair of spaced-apart stops provided at the other end of each of said journal boxes;

a first arcuate rack affixed to the upper cover of one of said journal boxes intermediate the ends thereof;

a second arcuate rack affixed to the lower cover of the other of said journal boxes intermediate the ends thereof;

an axle rotatably mounted in the bore of each of said king pins, each of said axles having an outboard end non-rotatably coupled to one of said wheels and an inboard end mounted for travel between an associated pair of said stops;

a pinion gear carried by each of said axles intermediate the ends thereof, said pinion gears engaging associated ones of said racks and being coupled to associated ones of said axles in a manner such that said pinion gears will coact with said racks to swing said axles and rotate said king pins until said inboard ends of said axles engage associated ones of said stops, whereupon said pinions will remain stationary while said axles are rotated by said wheels; and means mounting said journal boxes to said chassis.

* * * * *